United States Patent [19]

Neumann

[11] 4,299,069

[45] Nov. 10, 1981

[54] PREFABRICATED WALL FACING PANELS

[76] Inventor: Alfred Neumann, P.O. Box 159, Acton, Ontario, Canada, L7J 2M3

[21] Appl. No.: 970,292

[22] Filed: Dec. 18, 1978

Related U.S. Application Data

[63] Continuation-in-part of Ser. No. 829,337, Nov. 28, 1977, abandoned.

[51] Int. Cl.[3] ..... E04B 1/38

[52] U.S. Cl. ..... 52/309.4; 52/314; 52/509; 52/593

[58] Field of Search ..... 52/309.4, 314, 315, 52/593, 509, 763

[56] References Cited

U.S. PATENT DOCUMENTS

| | | | |
|---|---|---|---|
| 1,156,753 | 10/1915 | Carey | 52/593 |
| 2,006,635 | 7/1935 | Farr | 52/314 |
| 2,021,922 | 11/1935 | Peck | 52/593 X |
| 2,039,536 | 5/1936 | Johnson | 52/314 |
| 2,130,911 | 9/1938 | Teunon | 52/315 |
| 3,646,715 | 3/1972 | Pope | 52/315 X |
| 3,683,579 | 8/1972 | Beardsley | 52/311 |
| 3,715,417 | 2/1973 | Pope | 264/45 |
| 3,740,909 | 6/1973 | Stinnes | 52/315 X |
| 3,884,737 | 5/1975 | Bransford, Jr. | 156/63 |

FOREIGN PATENT DOCUMENTS

| | | | |
|---|---|---|---|
| 2551886 | 5/1977 | Fed. Rep. of Germany | 52/309.4 |
| 762464 | 11/1956 | United Kingdom | 52/593 |

*Primary Examiner*—Alfred C. Perham

[57] ABSTRACT

A prefabricated wall facing panel for buildings is described. A method of making such panels is also disclosed. The panels comprise a rigid polyurethane backing sheet and a plurality of facing elements embedded in said sheet. Tongue and groove formations at the respective upper and lower edges of the panel are provided for interlocking with adjacent panels. The panels are secured to a support surface by channel-shaped attachment members which can be nailed to the support surface and which engage in the grooves in the panels.

6 Claims, 5 Drawing Figures

PREFABRICATED WALL FACING PANELS

This is a continuation-in-part of U.S. Ser. No. 829,337 filed Nov. 28, 1977, now abandoned.

This invention relates generally to prefabricated wall facing panels for buildings.

An object of the invention is to provide a panel having thermal insulating properties.

According to the invention, the panel includes a rigid backing sheet of a thermally insulating material having an outer surface, a generally flat inner surface, two opposite side edges, and two opposite end edges. One of the side edges defines a longitudinally extending tongue, while the other side edge defines a complimentary groove, so that said panel can be interlocked with similar panels side edge-to-side edge by engaging the tongue on one panel in the groove in the relevant side edge of the adjacent panel. The end edges of the backing sheet are shaped so that the panel can also be brought into end-to-end abutment with an adjacent panel. A plurality of facing elements are distributed over and embedded in the outer surface of the backing sheet and are arranged to produce a simulated masonry appearance at the exterior surface of the panel.

The invention also provides a method of making a prefabricated wall panel. The method includes the step of providing a closable mould having a mould cavity of a size and shape corresponding to the required panel size and shape and including a bottom surface. A plurality of masonry facing elements are arranged face down on the bottom surface of the mould in a pattern corresponding to the required appearance of the resulting panel, with the elements spaced from one another to define spaces for simulated mortar seams. Granular material is distributed in the spaces between the elements and the backs of the facing elements are covered with a mesh sheet. Next, the mould is closed. A liquid material is then introduced into the mould cavity above the mesh sheet and is capable of setting to form a rigid backing sheet in which the facing elements are embedded, and which has thermal insulating properties. The mesh sheet is of a size which is at least semi-permeable to said liquid material so that the material will partially penetrate the mesh and flow into the spaces between the facing elements to retain said granular material in said spaces and thereby define the simulated mortar seams between the facing elements.

In order that the invention may be more clearly understood, reference will now be made to the accompanying drawings which illustrate a number of preferred embodiments of the invention by way of example, and in which:

FIG. 1 is a front perspective view of a prefabricated wall panel according to the invention;

FIG. 1*a* is a detail view illustrating how the panel of FIG. 1 fits end-to-end with an adjacent similar panel;

Figure 1:
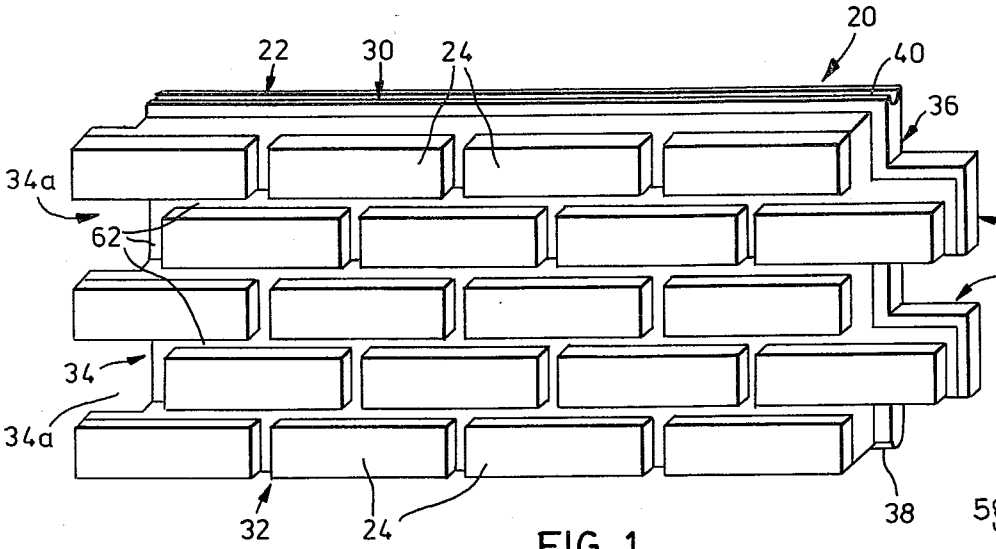

Referring first to FIG. 1, a wall panel is generally indicated at 20 and includes a rigid backing sheet 22 of a thermally insulating material and a plurality of facing elements 24 embedded in sheet 22. In this embodiment, the backing sheet is made of a rigid polyurethane foam and a specific example of a suitable foam will be given later. The facing elements 24 are in the form of slices of conventional masonry building bricks.

Figure 2:
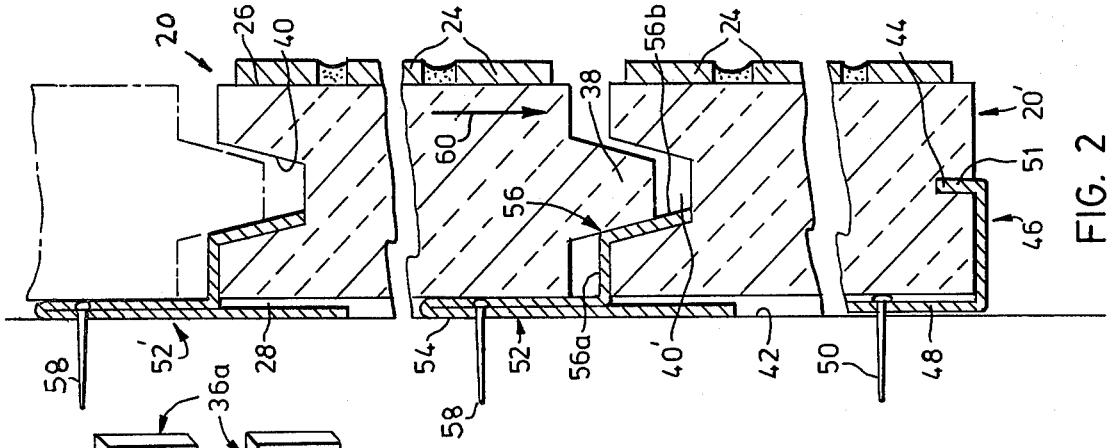
FIG. 2 is a vertical sectional view through a wall facing made up of a number of panels of the form shown in FIG. 1.
Figure 3:
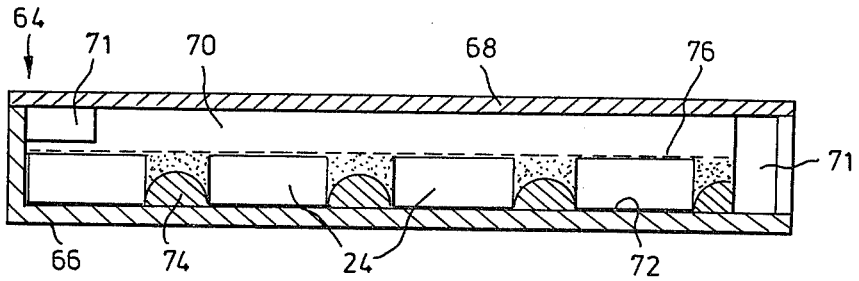
FIG. 3 is a diagrammatic vertical sectional view through a mould used for manufacturing the wall panel shown in the previous figures.

Backing sheet 22 is of generally rectangular form and has an outer surface 26 (FIG. 2), a generally flat inner surface 28, two opposite side edges 30 and 32, and two opposite end edges 34 and 36 (FIG. 1). As shown in FIGS. 1 and 3, the side edges 30 and 32 are horizontally disposed at the top and bottom respectively of the panel, although it is to be understood that the panels could be installed in other positions. Referring more particularly to FIG. 2, it will be noted that the bottom side edge 32 of each panel is shaped to define a longitudinally extending tongue 38 which is of truncated triangular shape in cross-section. The top side edge 30 of the panel is formed with a groove 40 which is of complimentary shape to tongue 38 and which extends longitudinally of that edge. Thus, as will be appreciated from FIG. 2, two similar panels disposed adjacent to one another can be interlocked by engaging the tongue on one panel in the complimentary groove on the other panel. As seen in FIG. 2, panel 20 is shown in an exploded position preparatory to being interlocked with an existing panel 20' which has previously been fitted to a support surface 42.

Panel 20' is a special panel designed to be used at the bottom of a facing assembled from panels of the form provided by the invention. Thus, panel 20' is the same as panel 20 except in that the tongue (38) which appears at the bottom of the backing sheet 22 of panel 20 has been removed and a groove or slit 44 has been provided along the bottom edge of the panel generally centrally of its width and extending parallel to the front and rear faces of the panel. In practice, panel 20' will normally be produced on site by modifying one of the panels 20. Thus, using a power saw, the tongue (38) at the bottom edge of one the panels 20 can be removed and the slit 44 formed by making two saw cuts.

In the illustrated embodiment, the facing formed by the panels is to be attached to surface 42 at a position above floor level. For this reason, a channel shaped attachment member indicated at 46 is provided for holding panel 20'. It will of course be appreciated that member 46 may not always be essential where the panel can be rested on some other form of support (e.g. a floor). However, even there, it may be desirable to provide such a member for security of fastening. In any event, in the illustrated embodiment, member 46 is generally channel shaped and includes a first limb 48 attached to support surface 42 by a nail indicated at 50, and a second limb 51 spaced laterally from limb 48 and received in the slit 44 in the bottom edge of panel 20'. It will of course be appreciated that the spacing between the two limbs 48 and 51 is selected so that the panel 20' is held snugly against surface 42. Member 46 will be made available in standard lengths and will be attached to support surface 42 as an initial step in assembling the facing formed by the panels as can best be seen in FIG. 3. Thus, several of the members 46 may be attached to the support surface in alignment with one another to in effect define a track for receiving the panels 20'. These panels are then slotted over the outer limbs of the members 46 and the members will temporarily support the panels in generally vertical positions.

The facing provided by the invention also includes a plurality of attachment members having the general shape of a lower case letter h. Two of these members are visible in FIG. 2 and are denoted by the reference numeral 52. It will be seen that each of the members includes a first limb 54 which is attached to support surface 42, and a second limb 56 which projects outwardly from limb 54 and is engaged in the groove at the upper side edge of the relevant panel. Limb 56 is of angled shape and includes a generally horizontal portion 56*a* which projects outwardly from limb 54 generally normal thereto, and an outer end portion 56*b* which extends downwardly from portion 56*a* at an inclination corresponding to the inclination of the relevant side wall of the groove in the panel. The first limb 54 of the member is held flush against the support surface 42 by a nail 58 driven through a hole in the member. Limb 56 is shaped so that the spacing between its outer end portion 56*b* and limb 54 is slightly greater than the thickness of the backing sheet of the panel between the groove in its upper side edge (40 or 40') and the inner face (28 or 28') of the backing sheet. Thus, the panel is held securely and firmly against support surface 42.

As in the case of attachment member 46, member 52 will be made available in standard lengths which will be attached to support surface 42 in alignment with one another according to the length of the run of panels to be fitted to the surface. In FIG. 2, a bottom panel 20' has been shown in its final position in contact with surface 42. It will be seen that the attachment member(s) 52 at the upper side edge of panel 20' have been firmly nailed to surface 42 at the required vertical spacing from the bottom attachment members 46. Subsequent panels such as the panel indicated at 20 in FIG. 2 can then be engaged downwardly with panel 20' by engaging the tongue 38 in the bottom side edge of panel 20 in the groove 40' at the top of panel 20' generally in the direction indicated by arrow 60 in FIG. 2. Panel 20 will be brought down to the position indicated in chain dotted outline in which tongue 38 is fully engaged in groove 40'. The outer portion 56*b* of limb 56 of attachment member 52 can also be accommodated in groove 40' due to manufacturing tolerances in practice, and the fact that backing sheet 22 is of a cellular nature (being made of a foamed polyurethane material) and is therefore compressible to some extent. When panel 20 reaches its fully engaged position, further attachment members such as those indicated at 52' in FIG. 2 are then engaged with the groove 40 at the top of panel 20 and nailed to support surface 42 in the same manner as member 52.

Figure 1A:
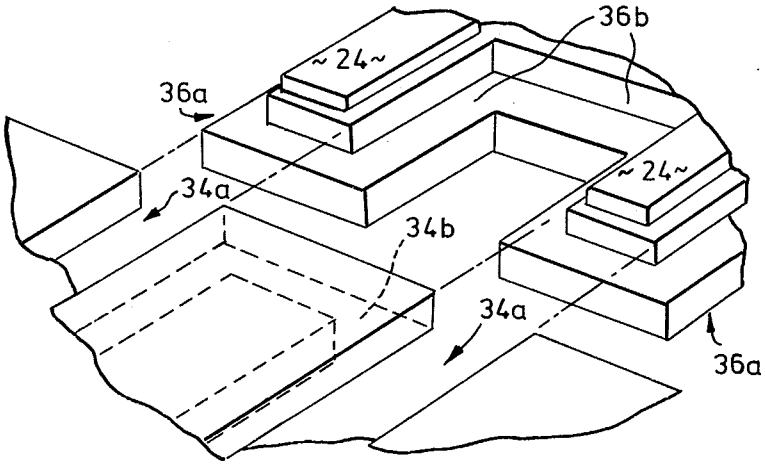

Referring to FIGS. 1 and 1*a*, the panels 20 (and 20') are also designed so that they can be interlocked with one another end-to-end. Thus, it will be seen (FIG. 1) that the end edges 34 and 36 of the panel are stepped so that one end of each panel can be engaged with the corresponding opposite end of an adjacent panel. Thus, edge 36 is formed with two generally rectangular protuberant portions 36*a* while the end edge at the opposite end of the panel is formed with complimentary recesses 34*a* so that the protuberant portions 36*a* on one panel can be engaged in the recess 34*a* on an adjacent panel. FIG. 1*a* shows two of the protuberant portions 36*a* on a panel preparatory to engagement in complimentary recesses 34*a* of an adjacent panel. It will be seen that the backing sheet 22 is shaped to define rebates 36*b* which extend around portions 36*a* and the intervening part of the backing sheet, and that the corresponding portion of the backing sheet surrounding recesses 34*a* is formed with complimentary rebates 34*b* so as to make for a tight thermal joint at the junction between two panels. This shaping of the ends of the panels is achieved by forming the backing sheet 22 of the panel in the shape described.

The facing elements 24 are embedded in backing sheet 22 in a plurality of horizontal rows in which the bricks in each row are longitudinally staggered with respect to the bricks in adjacent rows in the manner of a conventional brick wall. While this particular arrangement is not essential to the invention, it will be appreciated that the arrangement shown does lend itself conveniently to the shaping of the end wall 34 and 36 described above. Thus, when two similar panels are interlocked end-to-end, the bricks which project to the left-hand end of the panel (as viewed in FIG. 1) will fit snugly into the spaces at the righthand end of an adjacent panel so as to form a continuous surface of brick-like appearance. The spaces between facing elements are generally indicated by reference numeral 62 in FIG. 1 and are dimensioned to correspond with the dimensions of mortar seams conventionally found in brick walls. Silica sand is used in the spaces to provide a simulated mortar seam effect as will be more particularly described in connection with FIG. 3.

Figure 4:
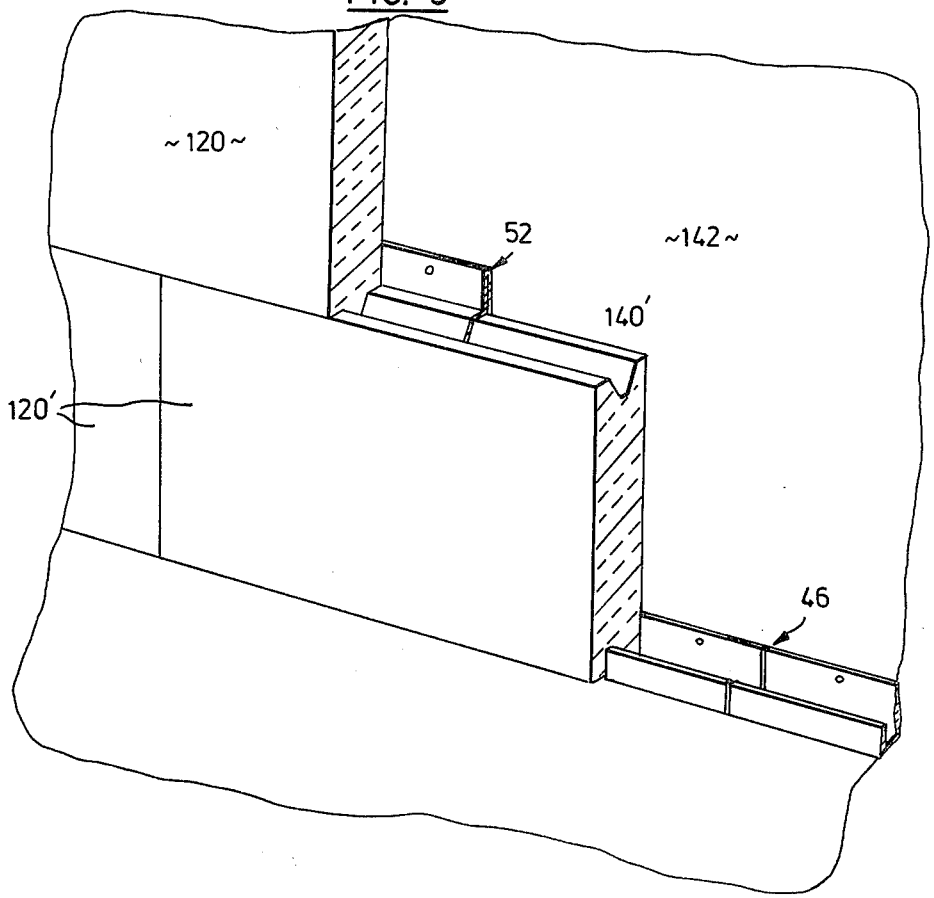
FIG. 4 is a perspective view showing part of a wall facing according to a further embodiment of the invention; and, FIG. 5 is a view similar to FIG. 2 and illustrates a modified wall panel according to the invention.

In FIG. 3 a mould is generally indicated at 64 and includes a lower portion 66 and a closable lid 68. The mould defines a cavity 70 and has end walls shaped to define the stepped configuration of the ends of panel 20 as shown in FIG. 1. Details of the mould construction have not been shown since they are essentially conventional and will be readily apparent to a person skilled in the art. For present purposes, it is sufficient to note that the top 68 of the mould is removable but can be clamped tightly in the closed position in which it is shown in FIG. 4 for moulding of a panel. The mould is fitted with inserts 71 for defining the protuberant portions 36*a* and recesses 34*a* of the panel.

The lower mould part 66 has a bottom surface 72. The first step in the method is to arrange the masonry facing elements 24 face down on surface 72 in a pattern corresponding to the required appearance of the panel. Thus, in the case of the panel 20 shown in FIG. 1, the facing elements would be arranged in a plurality of parallel rows with the elements in each row longitudinally staggered as shown in FIG. 1. Half round steel spacer bars such as those indicated at 74 in FIG. 4 are then laid in the spaces between the facing elements 24 with their flat sides down. The number and arrangement of these bars will depend on the particular panel being manufactured. In the case of the panel shown in FIG. 1, the bars will be arranged in a grid-like configuration corresponding to the spaces 62 shown in FIG. 1. In any event, all of the spaces between the facing elements will be filled with bars 74. Silica sand is then distributed in the spaces on top of the bar 74 so as to fill the spaces substantially to the level of the backs of the facing elements 24.

The next step in the method is to cover the backs of the facing elements (and the silica sand) with a mesh sheet or veil as indicated at 76. In a preferred embodiment of the invention, sheet 76 is a glass fiber mesh manufactured by Fiberglass of Canada Limited. Typically, a number 50 mesh would be used, although coarser meshes such, for example, as a number 35 mesh have also been found to be satisfactory.

When the mesh sheet is in place, the liquid polyurethane material is introduced into the mould cavity above the mesh sheet 76 and the mould is then closed. The polyurethane material comprises two components which are mixed immediately and then manually poured into the mould cavity, and which foam up inside the cavity to fill the space above mesh sheet 76. The mesh is of a size which is at least semi-permeable to the liquid material so that the material will partially penetrate the mesh and flow into the silica sand around the facing elements. When the polyurethane material dries, the facing elements will be embedded therein and the silica sand will be retained in the spaces between the facing elements and will present to the exterior of the panel simulated mortar seam effect. The half round bars 74 will impart a concave shape to the mortar seams, enhancing the realistic visual effect.

The polyurethane material is essentially a standard two component urethane formulated to provide a minimum of freon gas for blowing, so that the resulting rigid urethane is of high density, has a high compressive strength, good stability and good thermal insulating properties. In a preferred embodiment, the urethane material is that sold under the name Iroquois No. 2 comprising resin No. 0095 and blowing agent No. 0018 and the density of the resulting foam is in the range 2.3 to 2.7.

In an alternative embodiment of the invention, the mesh sheet 76 referred to in connection with FIG. 4 may be coated with a latex material and dried prior to being placed in the mould. The reaction which occurs when the two components of the polyurethane material mix is exothermic and the heat produced softens the latex so that it, in effect, forms a glue for promoting improved adherance between the backing sheet and both the facing elements and the material in the spaces between the elements. This modification may be particularly significant in a panel in which large size granular material (e.g. up to ¼ inch diameter pebbles or stones) is to be provided in the spaces between the facing elements of the panel rather than silica sand.

FIG. 4 shows part of a wall facing constructed from panels which are similar to the panels 20 shown in the previous views except that they do not include the mansonry facing elements 24 and have flat end faces. These panels are denoted 120 and the panels at the bottom of the facing are denoted 120'. The facing is applied to a support surface 142 such as the face of a wall (interior or exterior) in a domestic dwelling. The first step is to attach to the wall a number of bottom attachment members 46 so as to make up a length corresponding to the required length of wall to be faced. The attachment members are positioned horizontally on the wall and are aligned with one another. A number of bottom panels 120' appropriate to the length of the wall to be faced, are then engaged with the attachment members 46 as described previously and supported in generally upright positions against surface 142. A number of upper attachment members 52 are then engaged in grooves 140' at the upper side edges of the panels 120' and attached to surface 142 as described. Next, a row of panels 120 is laid on top of the row of bottom panels 120' in longitudinally staggered relationship with respect to the panels 120' as represented by one panel 120 in FIG. 3. Those panels are in turn secured to the wall by attachment members 52 which are engaged in the grooves 140 of the panels 120 and construction of the facing proceeds in this fashion. Obviously, it is not essential that any one row of panels should be completed before the next row is commenced, although in practice this may be desirable. For example, in FIG. 3, only part of the bottom row of panel 120' has been installed, and it will be appreciated that the assembly of the facing could proceed both upwardly and along the wall and may be convenient. The outer faces of the panels may be finished in any convenient fashion.

Figure 5:
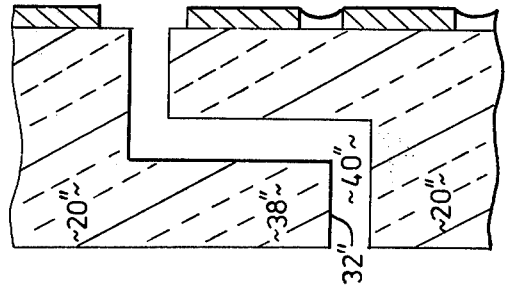

Finally, FIG. 5 shows a modified form of tongue and groove arrangement for interlocking the panels side edge-to-side edge. In that view, two similar panels are shown at 20'' one above the other. The upper panel has a bottom side edge 32'' formed with a tongue 38'' at the front of the backing sheet of the panel. The lower panel 20'' is formed with a groove 40'' for receiving tongue 38'', in the form of a longitudinally extending rebate along the front of the backing sheet.

A primary advantage of the invention is that a wall facing constructed from the panels of the invention provides a high degree of thermal insulation combined with a virtual absence of "heat leakage paths" through the facing. Thus, the attachment members used for securing the panels to a support surface engage in the grooves in the side edges of the panels and do not protrude to the exterior of the panels. The grouting applied to the joint faces between the panels provides an effective thermal seal. There is no need for nails or other fastening elements extending through the panels which would provide routes for thermal leakage through a facing.

It will of course be appreciated that the preceding description relates to a specific embodiment of the invention and that many modifications are possible within the broad scope of the claims.

For example, while in the specific embodiment reference is made to facing elements (24) in the form of slices of conventional brick, there is no limitation in this regard. Irregular shaped stones or other facing materials could be used. Similarly, as indicated above, other materials may be used in the spaces between the facing elements. Silica sand and pebbles have been referred to in the preferred embodiment although any appropriate granular material may be used. The material can be appropriately coloured to provide the required visual effect. In some instances, the granular material could even be omitted. In that event, it might be desirable to colour the polyurethane material to produce an attractive visual effect.

It will also be appreciated that the shape of the tongue and groove formations at the side edges of the panels may vary. Similarly, the end edges could be differently shaped. In another embodiment, flat end faces could be used and the panels could be simply butted end-to-end. In any event, the joints between the panels will normally be filled with a suitable grouting material.

The attachment memeber 46 and 52 described in connection with the preferred embodiment of the invention may also vary. In the particular embodiment shown in the drawings, these members are formed from sheet metal although it is to be understood that there is no limitation in this regard. It should also be noted that the attachment members may be secured to support surface in any convenient fashion. Nails have been specifically referred to, although other fastening means such as screws, ramset nails or the like may be employed. The attachment members may be secured not only to vertical surfaces as described but also to horizontal surfaces, roof surfaces etc. The attachment members provided by the invention may be used not only for attaching panels of the form specifically referred to herein, but also for any appropriate form of panel whether made of a thermally insulating material or otherwise. Lightweight concrete panels, for example, be attached in this way.

In regard to the panels themselves, as noted previously, it is not essential to employ masonry facing elements for providing a decorative surface. In some applications (e.g. where the panels are to be used at the exterior of a wall), no decorative facing will be required on the panels. A tar base coating may be used in that event, although it should be noted that the panels are waterproof and do not require a separate water-proof coating. In another embodiment, it would even be possible to attach conventional gypsum wall board to the panels.

Referring finally to the mould shown in FIG. 3 of the drawings, it will of course be understood that spacer bars other than those of the form specifically shown may be used. Also, the spacer bars can be permanently attached to the bottom surface of the mould so as to form an integral part of the mould. In fact, where the mould is used on a production basis, this will normally be the case.

I claim:

1. A wall facing applied to a support surface and comprising a plurality of prefabricated wall panels, and means attaching said panels to said surface;

said panels each comprising:

a rigid sheet of a thermally insulating material having an outer surface, a generally flat inner surface, two opposite end edges, and two opposite side edges;

the panels being arranged in a plurality of aligned horizontal rows including a bottom row with said side edges disposed horizontally and with the panels in each row in abutting end-to-end relationship, the lower side edges of the panels in said bottom row being formed with aligned longitudinally extending grooves and the remaining side edges of the panels being shaped to define co-operating tongues and grooves, the rows of panels being interlocked with one another by engagement of the tongue and groove side edges of the respective panels;

and wherein said means attaching the panels to a support surface consists solely of a plurality of elongate attachment members disposed at the inner sides of said panels generally co-extensively with joint lines defined by said side edges of the panels, each of said attachment members comprising a first limb attached to said support surface, and a second limb which projects outwardly from said first limb and is engaged in said groove of at least one of the panels, the attachment members at the lower side edges of the panels in said bottom row being generally U-shaped with said first limbs longer than said second limbs and the remaining attachment members having a cross-sectional shape resembling a lower case letter h.

2. A wall facing as claimed in claim 1, wherein said tongue is of truncated triangular shape in cross-section and extends longitudinally and generally centrally of the relevant side edge of the panel.

3. A wall facing as claimed in claim 1, wherein said thermally insulating material is a rigid polyurethane foam.

4. A wall facing as claimed in claim 1, wherein said facing elements are spaced from one another to define simulating mortar seams between the elements, and wherein the panel further includes granular material disposed in said spaces and bonded to the thermally insulating material for simulating the appearance of mortar.

5. A wall facing as claimed in claim 1, wherein said end edges of each panel are shaped so that the panel can be interlocked end-to-end with adjacent panels in the same row, one of said side edges including at least one formation protuberant from the relevant edge, while the other end edge includes a complimentary recess for receiving said protuberant formation on an adjacent panel.

6. A wall facing as claimed in claim 1, wherein each said panel further comprises a plurality of facing elements distributed over and embedded in said outer surface of the backing sheet and arranged to produce a simulated masonry appearance at the exterior surface of the panel.

* * * * *